US006722531B2

(12) United States Patent
Matsuo et al.

(10) Patent No.: US 6,722,531 B2
(45) Date of Patent: Apr. 20, 2004

(54) POURING MOUTH MEMBER FOR CONTAINER

(75) Inventors: Naoshi Matsuo, Kanagawa (JP); Tsuneo Imatani, Kanagawa (JP); Kimio Takeuchi, Kanagawa (JP)

(73) Assignee: Toyo Seikan Kaisha, Ltd., Tokyo (JP)

( * ) Notice: Subject to any disclaimer, the term of this patent is extended or adjusted under 35 U.S.C. 154(b) by 203 days.

(21) Appl. No.: 09/985,172

(22) Filed: Nov. 1, 2001

(65) Prior Publication Data

US 2002/0079241 A1 Jun. 27, 2002

(30) Foreign Application Priority Data

Dec. 27, 2000 (JP) ..... 2000-396862
Dec. 28, 2000 (JP) ..... 2000-403311
Jan. 19, 2001 (JP) ..... 2001-011010

(51) Int. Cl.[7] ..... B65D 35/00

(52) U.S. Cl. ..... 222/92; 222/105; 222/107; 215/42

(58) Field of Search ..... 222/92, 107, 105; 215/42, 44; 220/659, 645

(56) References Cited

U.S. PATENT DOCUMENTS 3,784,038 A * 1/1974 Uhlig ..... 215/44
4,132,331 A * 1/1979 Magerle ..... 222/107
4,685,591 A * 8/1987 Schaefer et al. ..... 222/107
5,364,675 A * 11/1994 Guarriello et al. ..... 428/35.7
5,804,270 A * 9/1998 Kawamura et al. ..... 428/36.92
6,264,050 B1 * 7/2001 Darr et al. ..... 215/40
2003/0132188 A1 * 7/2003 Beek et al. ..... 215/44

* cited by examiner

*Primary Examiner*—Joseph A. Kaufman
(74) *Attorney, Agent, or Firm*—Browdy and Neimark

(57) ABSTRACT

A pouring mouth member for a container includes an intermediate resin layer having barrier property and a fold-back portion is formed on at least one end portion of the intermediate resin layer having barrier property. Further, due to an inner layer resin and/or an outer layer resin provided to an outer periphery of this fold-back portion, the exposure of the resin having barrier property can be surely prevented and, at the same time, a cut edge of the intermediate resin layer having barrier property is effectively sealed between the inner and outer layer resins since the cut edge is also in a fold-back state.

8 Claims, 13 Drawing Sheets

POURING MOUTH MEMBER FOR CONTAINER

BACKGROUND OF THE INVENTION

1. Field of the Invention

The present invention relates to a pouring mouth member which is provided with an intermediate resin layer having barrier property which is integrally formed with a tubular container or a container such as a pouch or the like, and more particularly, to a pouring mouth member for a container which is continuously formed to prevent the exposure of an end portion of the intermediate resin layer having barrier property of the pouring mouth member.

2. Description of the Related Art

Conventionally, for pouring a content such as mustard or horseradish in a paste form or toothpaste from a container such as a tubular container, a beverage pouch, a transfusion pouch or the like which contains the content, a pouring mouth member is connected to the container and such a container has been widely used as a tubular container or a pouch provided with a pouring opening member.

Further, for making use of advantages that respective resins have and for compensating for defects that respective resins have, multi-layered containers have been used in various fields of packaging.

For example, by making use of the moisture resistance and the hygiene which polyolefin resin has, a container which uses the polyolefin resin as material of an inner layer thereof, uses resin having barrier property such as ethylene-vinyl alcohol copolymer or the like as material of an intermediate layer to compensate for the deficiency of gas barrier property of the polyolefin resin and laminates these inner layer and the intermediate layer has been widely used.

In this case, the polyolefin layers which are formed at both sides of the ethylene-vinyl alcohol copolymer layer perform the complementary action to prevent the lowering of the barrier property of the ethylene-vinyl alcohol copolymer layer due to moisture.

On the other hand, a technique to adopt a multi-layered pouring mouth member in a container such as a pouch or the like is proposed by Japanese Laid-open Patent Publication 128317/1999, for example.

SUMMARY OF THE INVENTION

By providing a resin layer having barrier property also to a pouring mouth member for a container, the vaporization of a flavor component to the outside of the container can be prevented and the transmission of oxygen into the inside of the container is suppressed where by the preservation of a content is enhanced.

However, a conventional multi-layered pouring mouth member for a container which uses the resin having barrier property as the intermediate layer is liable to expose the intermediate layer formed of resin having barrier property at an upper end portion and/or at a lower end portion thereof. Accordingly, there have been problems such as the lowering of barrier property due to the absorption of moisture by the resin having barrier property, the peeling-off of the resin having barrier property, the unnecessary contact with a content and the insufficient hermetic contact between the pouring mouth member and the container.

Accordingly, it is an object of the present invention to provide a pouring mouth member for a container which is integrally formed with a tubular container or a container such as a pouch or the like and which is continuously formed to prevent the exposure of an end portion of the intermediate resin layer having barrier property of the pouring mouth member.

BRIEF DESCRIPTION OF THE DRAWINGS

FIG. 14 is a reference cross-sectional view of a pouring mouth member for a container of the present invention when it is used as a pouring mouth member of a transfusion pouch or the like.

FIG. 15 is a reference cross-sectional view of another example of a pouring mouth member for a container of the present invention when it is used as a pouring mouth member of a transfusion pouch or the like.

FIG. 16 is a reference cross-sectional view of still another example of a pouring mouth member for a container of the present invention when it is used as a pouring mouth member of a transfusion pouch or the like.

BEST MODE OF CARRYING OUT THE INVENTION

Figure 1:
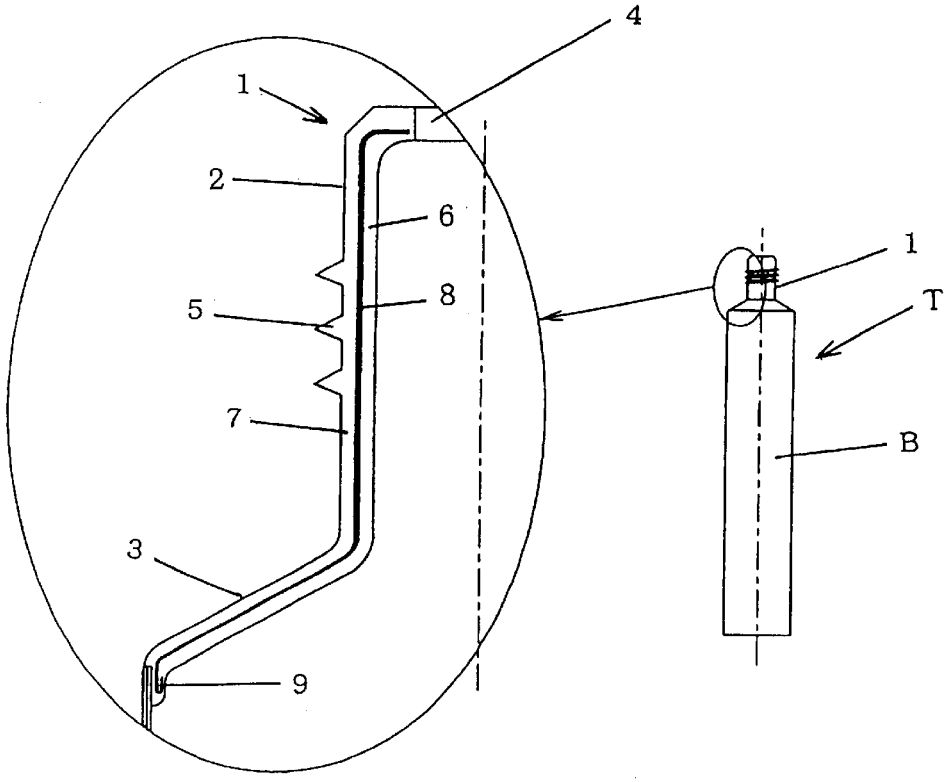
FIG. 1 is a reference cross-sectional view of a pouring mouth member for a container of the present invention when it is used as a pouring mouth member of a tubular container.

The present invention relates a pouring mouth member which is integrally connected to a container such as a tube, a pouch or the like and is particularly characterized in that the pouring mouth member is formed of plastic having an intermediate resin layer having barrier property and a fold-back portion is formed on an intermediate layer having barrier property disposed at least one end side of the pouring mouth member.

As pointed out previously, when the pouring mouth member made of plastic is connected to the container such as the tube, the pouch or the like, it is preferable to have an intermediate layer formed of resin having barrier property in the pouring mouth member from a viewpoint of the preservation of a content.

However, in forming this multi-layered pouring mouth member, for example, a cylindrical portion or a sleeve which is obtained by extruding resin and cutting to a fixed size is used. Here, however, at an end peripheral portion (cut edge) of the cylindrical portion or the sleeve, there exists a problem that the intermediate resin layer having barrier property is exposed.

According to the present invention, even when the cylindrical portion, the sleeve or the like for the multi-layered pouring mouth member is used, by forming the fold-back portion on the end portion of the intermediate resin layer having barrier property at the time of forming the pouring mouth member for a container, it becomes possible to effectively solve the above-mentioned problem.

That is, by forming the fold-back portion on the end portion of the intermediate resin layer having barrier property, due to the inner layer resin and/or outer layer resin provided to an outer periphery of the fold-back portion, the exposure of the resin having barrier property can be surely prevented and, at the same time, the cut edge of the intermediate resin layer having barrier property can be also effectively sealed between the inner and outer layer resins in a fold-back state.

[inner and outer layer resins]

Olefin resin is preferably used as the inner and outer layer resins of the pouring mouth member. As such olefin-based resin, in general, low-density polyethylene, intermediate-density polyethylene, high-density polyethylene, linear low-density polyethylene, linear ultra-low-density polyethylene, isotactic polypropylene, sydiotactic polypropylene, propylene-ethylene copolymer, ethylene-vinylacetate copolymer, ethylene-acrylic acid copolymer, ethylene-metha-acrylic metyl copolymer, ion cross-link olefin copolymer (ionomer) and the like are named.

[intermediate resin layer having barrier property]

As the resin having barrier property, thermoplastic resin which has a low transmission coefficient for various gases and is capable of being formed thermally can be used.

With respect to such resin having barrier property, any resin suitable depending on usage can be selected or combined can be served.

As the resin which exhibits the large barrier property against vapor, cyclic olefin-based copolymer or amorphous or low-crystalline copolymer (COC) of olefin and cyclic olefin is used.

As the olefin which constitutes the copolymer, ethylene is preferable. Besides the ethylene, α-olefin having carbon number of 3 to 20 such as propylene, 1-butene, 1-pentene, 1-hexane, 1-octene, 3-methl 1-pentene, 1-decene or the like can be used in a singular form or in combination.

As the resin having barrier property against oxygen and aroma components, ethylene-vinyl alcohol copolymer can be named. For example, copolymer saphonificated material which is obtained by saphonificating ethylene-vinyl-acetate copolymer which contains 20 to 60 mol % of ethylene, particularly 25 to 50 mol % such that the degree of saphonication becomes equal to or more than 96 mol %, and more particularly 99 mol % can be used.

Further, as an other example of the resin having barrier property which exhibits the above-mentioned characteristics, polyamides having the number of amide group in a range of 5 to 50, and more particularly in a range of 6 to 20 per carbon number of 100 such as nylon 6, nylon 6, 6, nylon 6/6, 6 copolymer, metha xylylene adipamido, nylon 6,10, nylon 11, nylon 12, nylon 13, hexa methylene terephthalamide/isophthalamide copolymer, or a mixture thereof, for example, can be used.

These resins having barrier propery generally have no adhesive property to the olefin resin and hence, it is preferable to interpose acid-modified olefin-based resin as an adhesive agent between the resin having barrier property and the olefin-based resin. As the olefin-based resin which constitutes a base of the acid-modified resin, above-mentioned all materials can be used.

A thickness of the intermediate resin layer having barrier property in the pouring mouth member for a container of the present invention is generally set to 5 to 300 μm and is particularly preferable to set to 10 to 100 μm. A thickness of the acid-modified olefin-based resin layer is generally set to 2 to 40 μm and is particularly preferably set in a range from 3 to 30 μm.

On the other hand, a coating width of the inner and outer resin layers at the end portion side of the intermediate resin layer having barrier property is preferably set as follows from a viewpoint of the influence of a content to the resin having barrier property and the shock resistance. That is, the coating width at the upper end portion side of the pouring mouth member is set to 0 to 1000 μm, while the coating width at the lower end portion side of the pouring mouth member is set to 5 to 1000 μm when the pouring mouth member is used as a pouring mouth member of a tubular container and to 5 to 5000 μm when the pouring mouth member is used as a pouring mouth member of a pouch.

Further, it is preferable to arrange the intermediate resin layer having barrier property close to the outer layer resin from a viewpoint of gas barrier property and the prevention of the degeneration of flavor or the like of the content.

The pouring mouth member for a container of the present invention is explained hereinafter in conjunction with the attached drawings.

Figure 2:
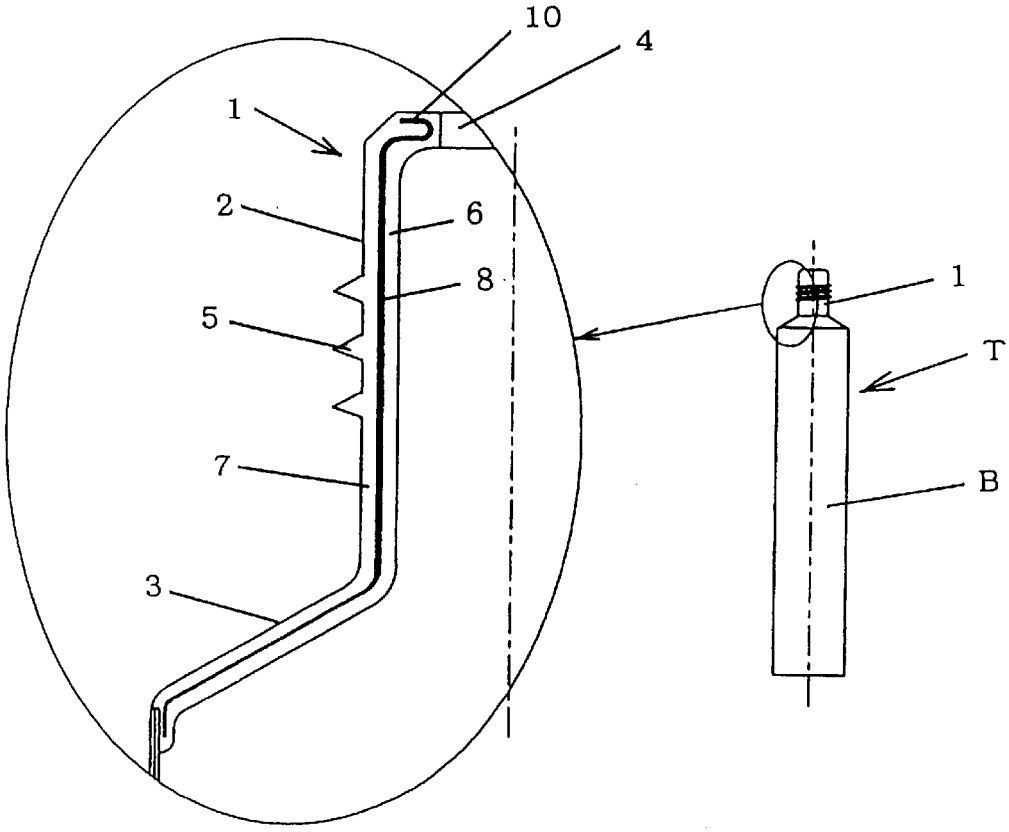
FIG. 2 is a reference cross-sectional view of another example of a pouring mouth member for a container of the present invention when it is used as a pouring mouth member of a tubular container.
Figure 3:
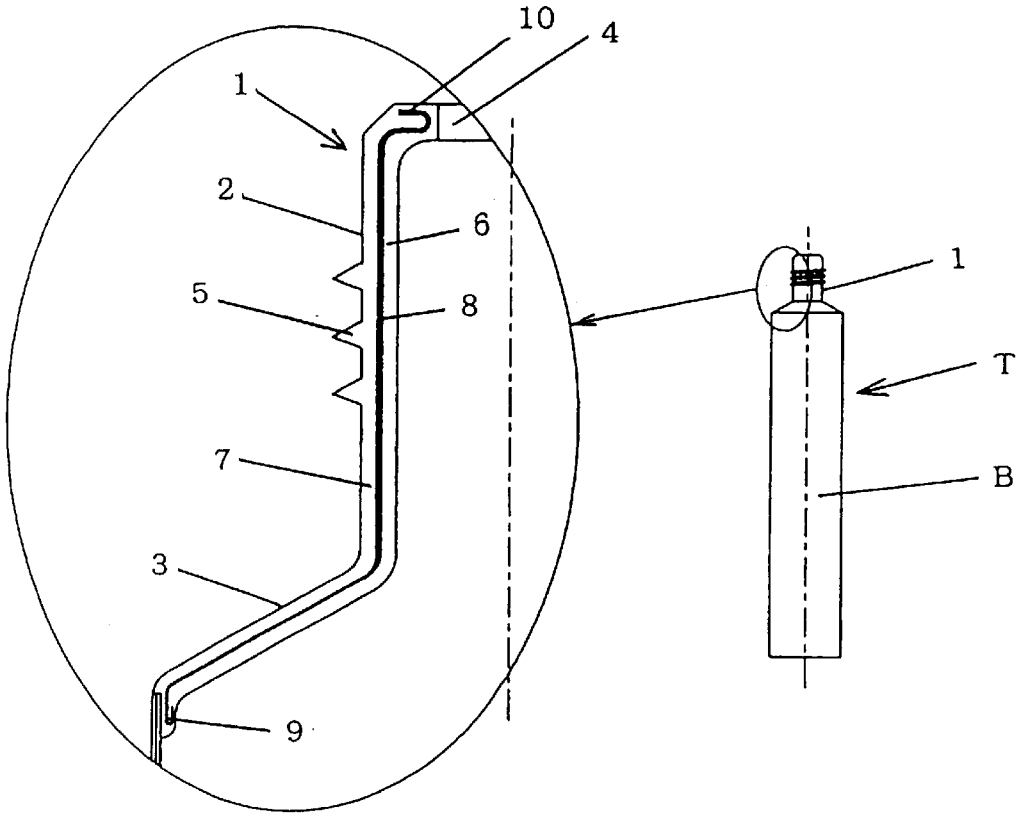
FIG. 3 is a reference cross-sectional view of still another example of a pouring mouth member for a container of the present invention when it is used as a pouring mouth member of a tubular container.

FIG. 1 to FIG. 3 are reference cross-sectional views of a pouring mouth member of the present invention when the pouring mouth member is used as a pouring mouth member of a tubular container.

The pouring mouth member 1 shown in FIG. 1 is a member which forms a tubular container T along with a drum portion B in a form that they are integrally connected with each other. The pouring mouth member 1 is used as a nozzle of the tubular container T and is comprised of a spout 2 and a shoulder portion 3. The spout 2 has a discharge opening 4 formed at one end (distal end) thereof and the other end thereof connected to the shoulder portion 3. An engaging portion 5 for fastening a cap is formed on an outer periphery of the spout 2.

A layer constitution of the pouring mouth member 1 in this example is comprised of an inner layer 6, an outer layer 7 and an intermediate resin layer 8 having barrier property. At a connecting side of the pouring mouth member 1 which is connected to the drum portion B of the tubular container T, that is, at a lower end portion of the pouring mouth member 1, a fold-back portion 9 is formed on an end portion of the intermediate resin layer 8 having barrier property.

Further, the fold-back portion 9 is coated with the inner layer 6 and/or the outer layer 7.

Then, the pouring mouth member (nozzle) 1 has a lower end portion thereof integrally connected to the drum portion B of the tubular container T by heat fusion thus forming the tubular container T.

In this example, although an end portion of the intermediate resin layer 8 having barrier property which is disposed at an upper end portion of the pouring mouth member 1 is sealed in the inside of the inner and outer layer resin for preventing the deterioration of the intermediate resin layer 8, the end portion of the intermediate resin layer 8 may be exposed.

In a pouring mouth member 1 shown in FIG. 2, a fold-back portion 10 is formed on an end portion of an intermediate resin layer 8 having barrier property which is disposed at an upper end portion of the pouring mouth member 1 connected to a drum portion B of a tubular container T. Further, the fold-back portion 10 is coated with an inner layer 6 and/or an outer layer 7. Other constitutions of this example are identical with the corresponding constitutions of the pouring mouth member 1 of the example shown in FIG. 1.

Further, in this example, it is preferable to prevent the end portion of the intermediate resin layer 8 having barrier property disposed at the lower end portion of the pouring mouth member 1 from being exposed as shown in the drawing from a viewpoint of the preservation of a content.

In a pouring mouth member 1 shown in FIG. 3, fold-back portions 9, 10 are respectively formed on end portions of an intermediate resin layer 8 having barrier property disposed at a connecting side of the pouring mouth member 1 which is connected with a drum portion B of a tubular container T, that is, a lower end portion and an upper end portion of the pouring mouth member 1. Further, the fold-back portions 9, 10 are coated with an inner layer 6 and/or an outer layer 7. Other constitutions of this example are identical with the corresponding constitutions of the pouring mouth member 1 of the example shown in FIG. 1.

Figure 4:
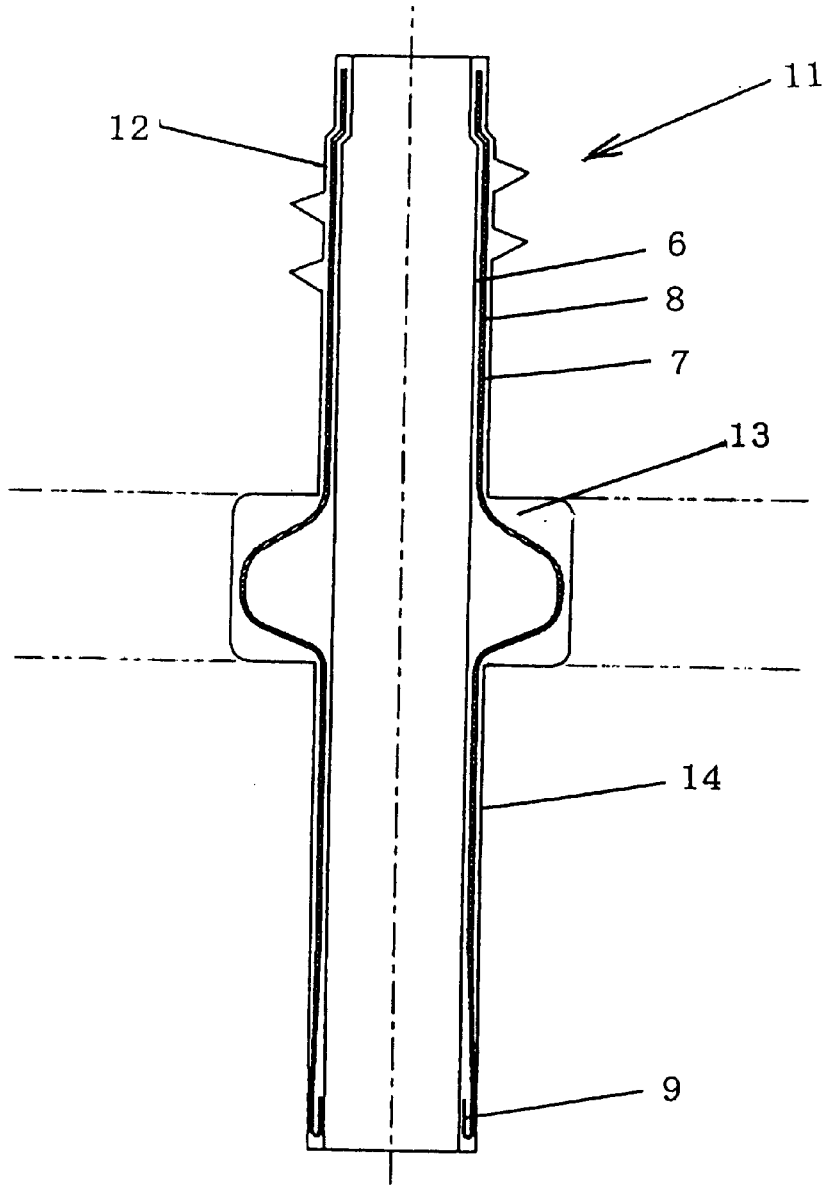
FIG. 4 is a reference cross-sectional view of a pouring mouth member for a container of the present invention when it is used as a pouring mouth member of a pouch.
Figure 5:
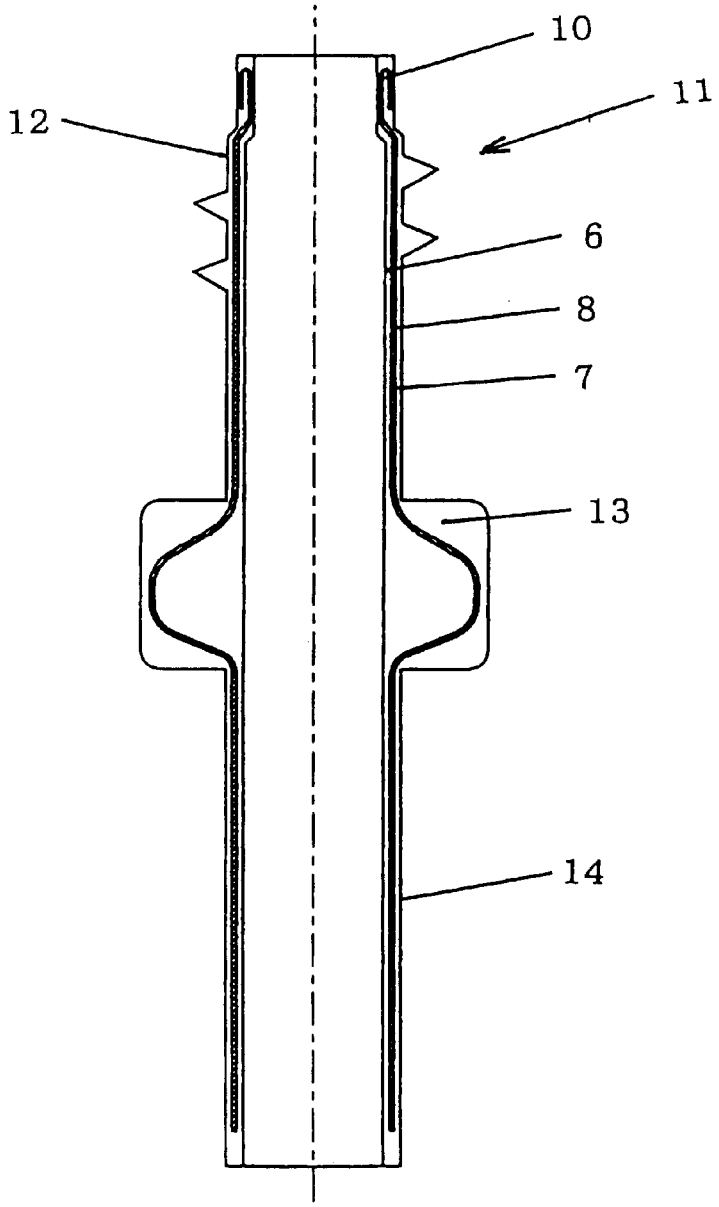
FIG. 5 is a reference cross-sectional view of a pouring mouth member for a container of the present invention when it is used as another example of a pouring mouth member of a pouch.
Figure 6:
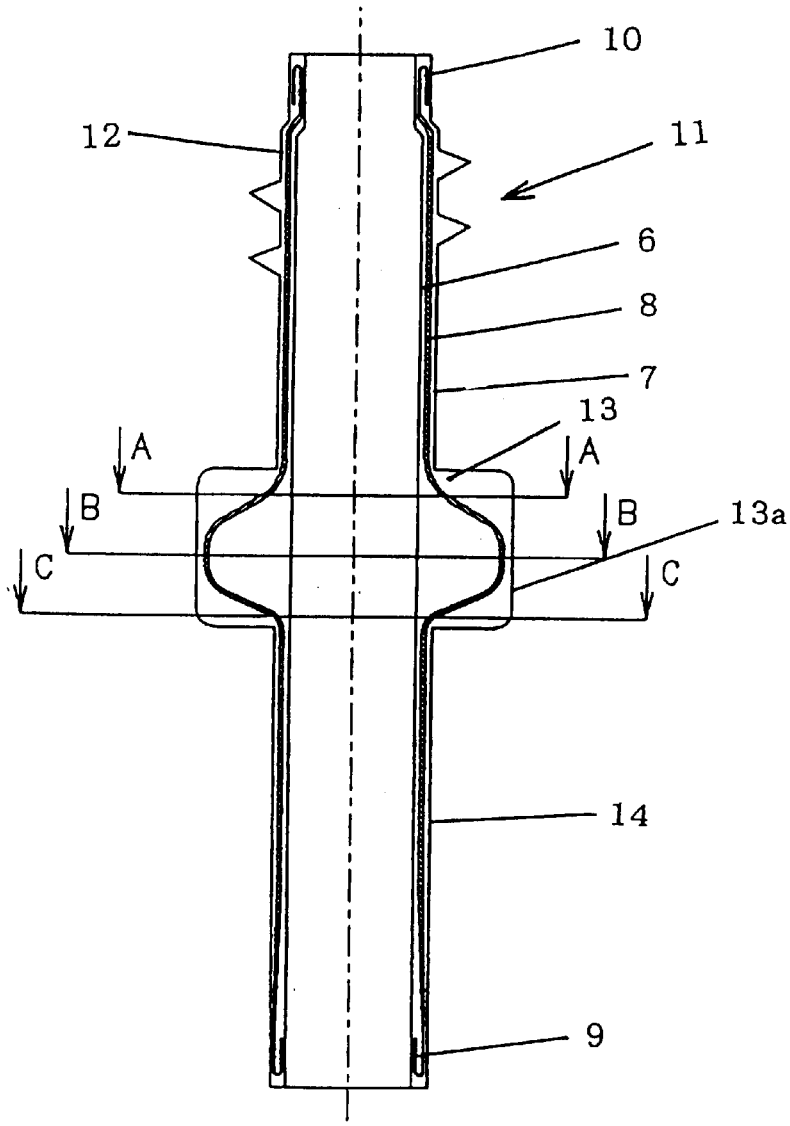
FIG. 6 is a reference cross-sectional view of a pouring mouth member for a container of the present invention when it is used as still another example of a pouring mouth member of a pouch.

FIG. 4 to FIG. 6 are reference cross-sectional views of a pouring mouth member for a container of the present invention when it is used as a pouring mouth member of a pouch.

A pouring mouth member 11 shown in FIG. 4 is comprised of a pouring mouth portion 12, a seal portion 13 and a conduit portion 14 and is used as a spout.

Then, the layer constitution of the pouring mouth member 11 of this example is comprised of an inner layer 6, an outer layer 7 and an intermediate resin layer 8 having barrier property. In such a constitution, the seal portion 13 is integrally formed on an opening portion of a pouch (indicated by a phantom line in the drawing) by heatsealing, a fold-back portion 9 is formed on a lower end portion of a conduit portion 14, that is, an end portion of the intermediate resin layer 8 having barrier property disposed at a lower end portion of the pouring mouth member 11, and the fold-back portion 9 is coated with the inner layer 6 and/or the outer layer 7.

In this example, the end portion of the intermediate resin layer 8 having barrier property disposed at the upper end portion of the pouring mouth member 11 may be exposed.

A pouring mouth member 11 shown in FIG. 5 is, in the similar manner, comprised of a pouring mouth portion 12, a seal portion 13 and a conduit portion 14. In such a constitution, a fold-back portion 10 is formed on an end portion of an intermediate resin layer 8 having barrier property disposed at an upper end portion of the pouring mouth portion 12, and the fold-back portion 10 is coated with the inner layer 6 and/or the outer layer 7. Other constitutions of this example are identical with the corresponding constitutions of the pouring mouth member 11 of the example shown in FIG. 4.

Further, in this example, it is preferable to prevent the end of the intermediate resin layer 8 having barrier property disposed at the lower end portion of the pouring mouth member 11 from being exposed as shown in the drawing from a viewpoint of the preservation of a content.

A pouring mouth member 11 shown in FIG. 6 is, in the similar manner, comprised of a pouring mouth portion 12, a seal portion 13 and a conduit portion 14. In such a constitution, fold-back portions 9, 10 are formed on end portions of an intermediate resin layer 8 having barrier property disposed at a lower end portion of a conduit portion 14 and at an upper end portion of the pouring mouth portion 12, and the fold-back portions 9, 10 are coated with the inner layer 6 and/or the outer layer 7. Other constitutions of this example are identical with the corresponding constitutions of the pouring mouth member 11 of the example shown in FIG. 4.

Figure 7:
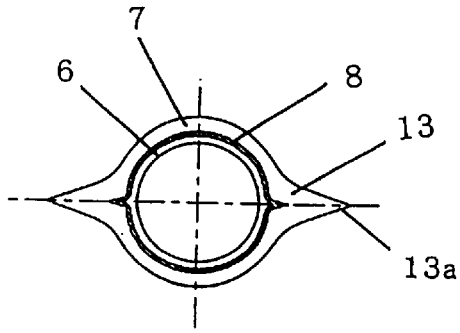
FIG. 7 is a cross-sectional view taken along A—A in FIG. 6.
Figure 8:
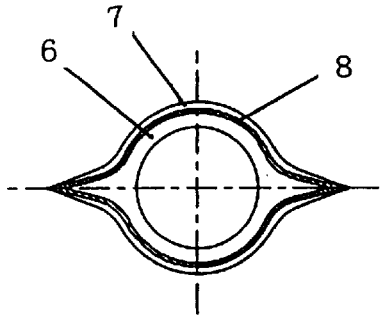
FIG. 8 is a cross-sectional view taken along B—B in FIG. 6.
Figure 9:
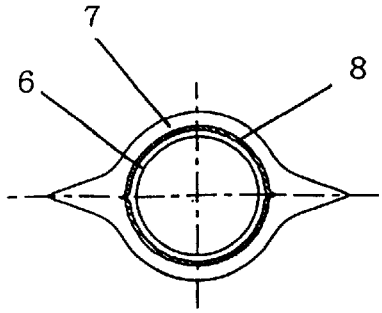
FIG. 9 is a cross-sectional view taken along C—C in FIG. 6.

Here, when the pouring mouth member for a container of the present invention is used as a pouring mouth member 11 which is integrally formed on the previously-mentioned pouch, as shown in FIG. 7 to FIG. 9, by continuously forming the intermediate resin layer 8 of the seal portion 13 such that the intermediate resin layer 8 is directed toward distal end portions 13*a* of the seal portion 13 substantially without lacking parts, the pouring mouth portion 11 is integrally formed with the pouch so that the gas barrier property can be further enhanced at the time of producing a pouch having a pouring mouth member.

FIG. 10 to FIG. 13 are other reference cross-sectional views of pouring mouth members for containers of the present invention when they are used as pouring mouth members of pouches.

Figure 10:
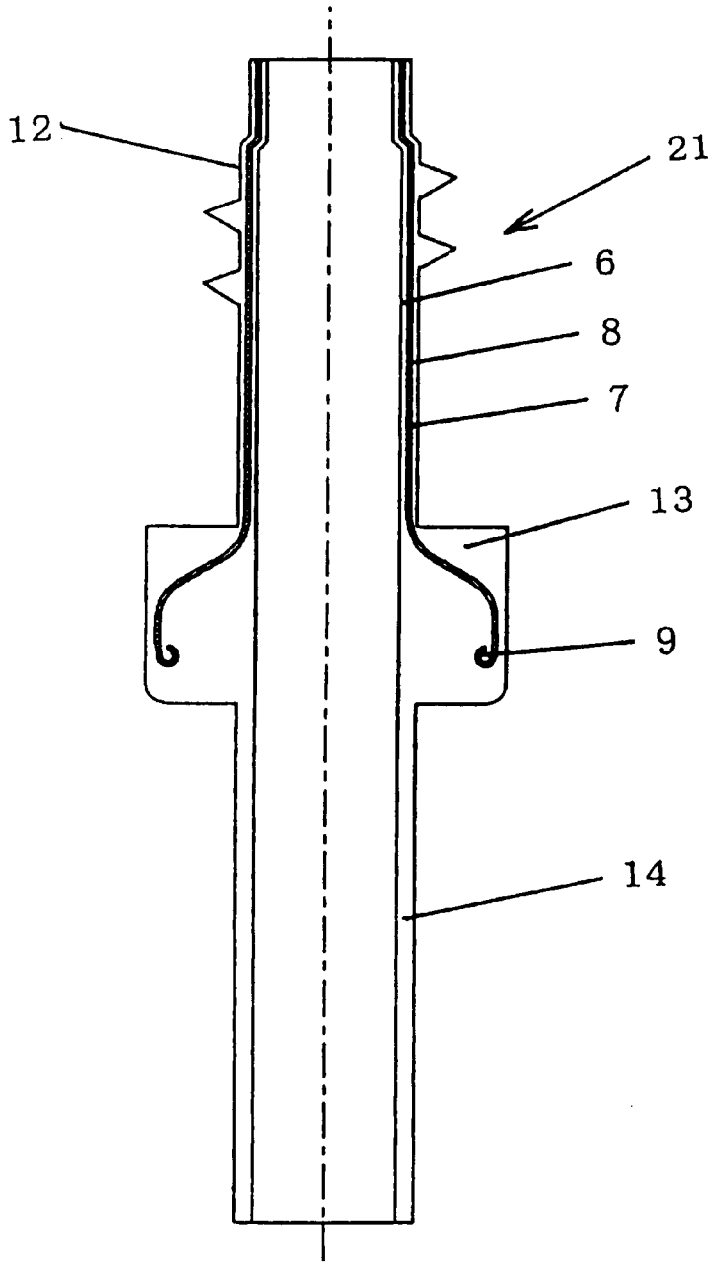
FIG. 10 is a reference cross-sectional view of a pouring mouth member for a container of the present invention when it is used as a pouring mouth member of a pouch.

A pouring mouth member 21 shown in FIG. 10 is, in the similar manner, comprised of a pouring mouth portion 12, a seal portion 13 and a conduit portion 14. The layer constitution of the pouring mouth member 21 in this example is also comprised of an inner layer 6, an outer layer 7 and an intermediate resin layer 8 having barrier property and is integrally formed with a pouch by heatsealing the seal portion 13 to an opening portion of a pouch.

In the pouring mouth member 21 of this example, a fold-back portion 9 is formed on an end portion of the intermediate resin layer 8 having barrier property disposed at the lower end portion of the seal portion 13 of the pouring mouth member 21 and, at the same time, the fold-back portion 9 is coated with the inner layer 6 and/or the outer layer 7.

Further, in this example, although the end portion of the intermediate resin layer 8 having barrier property disposed at the upper end portion of the pouring mouth member 21 is exposed, the end portion of the intermediate resin layer 8 may be sealed in the inner and outer layer resins to prevent the deterioration of the intermediate resin layer 8.

Figure 11:
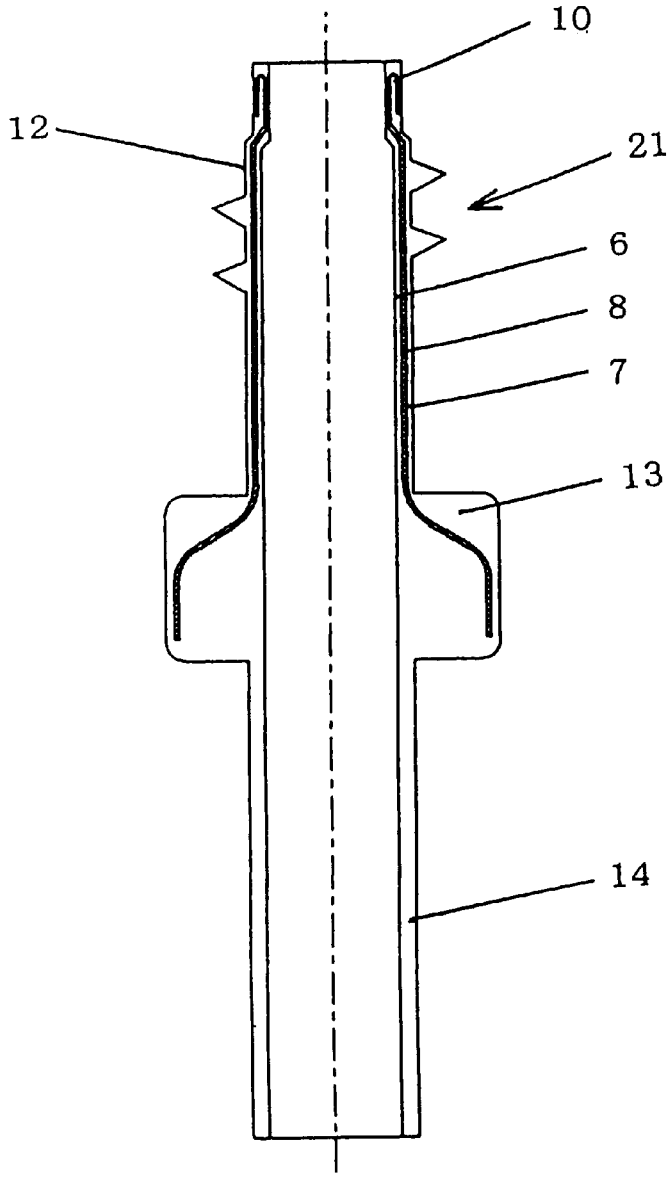
FIG. 11 is a reference cross-sectional view of another example of a pouring mouth member for a container of the present invention when it is used as a pouring mouth member of a pouch.

A pouring mouth member 21 shown in FIG. 11 is, in the similar manner, comprised of a pouring mouth portion 12, a seal portion 13 and a conduit portion 14. A fold-back portion 10 is formed on an end portion of an intermediate resin layer 8 having barrier property disposed at an upper end portion of the pouring mouth portion 12 and, at the same time, the fold-back portion 10 is coated with an inner layer 6 and/or an outer layer 7. Other constitutions of this example are identical with the corresponding constitutions of the pouring mouth member 21 of the example shown in FIG. 10.

Figure 12:
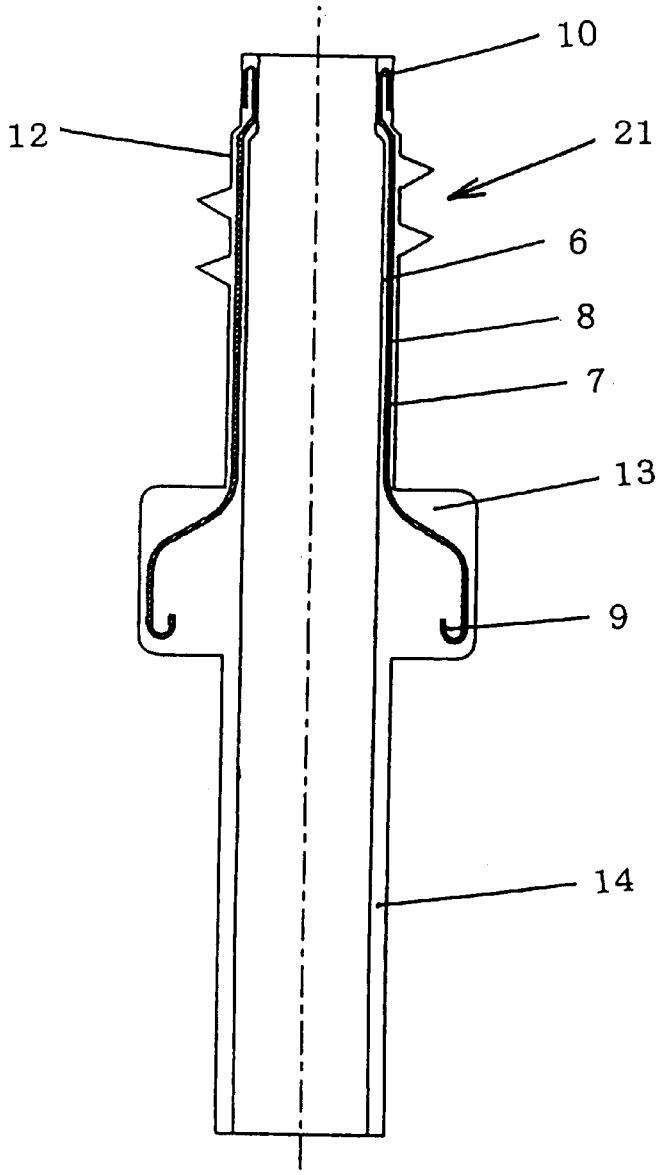
FIG. 12 is a reference cross-sectional view of still another example of a pouring mouth member for a container of the present invention when it is used as a pouring mouth member of a pouch.

A pouring mouth member 21 shown in FIG. 12 is, in the similar manner, comprised of a pouring mouth portion 12, a seal portion 13 and a conduit portion 14. Fold-back portions 9,10 are respectively formed on end portions of an intermediate resin layer 8 having barrier property disposed at a lower end portion of the seal portion 13 and at an upper end portion of the pouring mouth portion 12 and, at the same time, the fold-back portions 9, 10 are coated with an inner layer 6 and/or an outer layer 7. Other constitutions of this example are identical with the corresponding constitutions of the pouring mouth member 21 of the example shown in FIG. 10.

Figure 13:
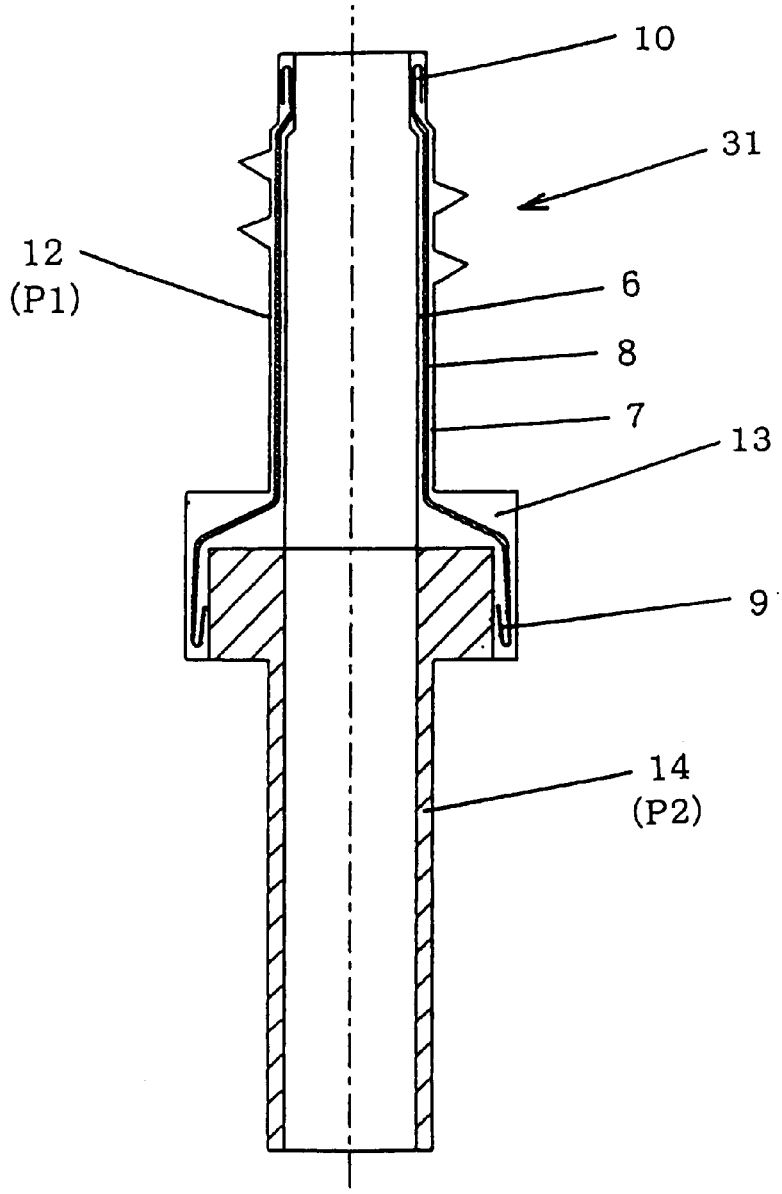
FIG. 13 is a reference cross-sectional view of still another example of a pouring mouth member for a container of the present invention when it is used as a pouring mouth member of a pouch.

A pouring mouth member 31 shown in FIG. 13 is, in the similar manner, comprised of a pouring mouth portion 12, a seal portion 13 and a conduit portion 14, wherein the pouring mouth portion 12 and the conduit portion 14 are constituted of separate pieces P1, P2 and are connected by heat fusion in the inside of the seal portion 13.

Here, fold-back portions 9, 10 are respectively formed on end portions of an intermediate resin layer 8 having barrier property disposed at a lower end portion of the seal portion 13 and at the upper end portion of the pouring mouth portion 12 and the fold-back portions 9, 10 are coated with an inner layer 6 and/or an outer layer 7. Other constitutions of this example are identical with the corresponding constitutions of the pouring mouth member shown in FIG. 12.

Here, although the fold-back portions 9, 10 are respectively formed on end portions of the intermediate resin layer 8 having barrier property in this example, it is enough for the pouring mouth member 31 to have the fold-back portion at least one end portion. Further, the connection of the pouring mouth portion 12 (P1) and the conduit portion 14 (P2) may be conducted by suitable means such as a thread engagement, an adhesion using an adhesive agent or the like besides the heat fusion.

Further, the connecting position is not limited to the inside of the seal portion 13 and the pouring mouth portion 12 and the conduit portion 14 may be connected by dividing the seal portion 13 in the height direction in halves.

Figure 14:
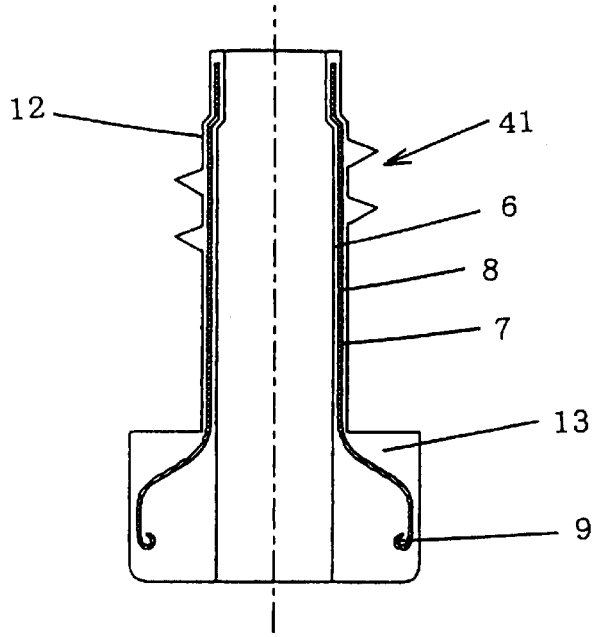
Figure 15:
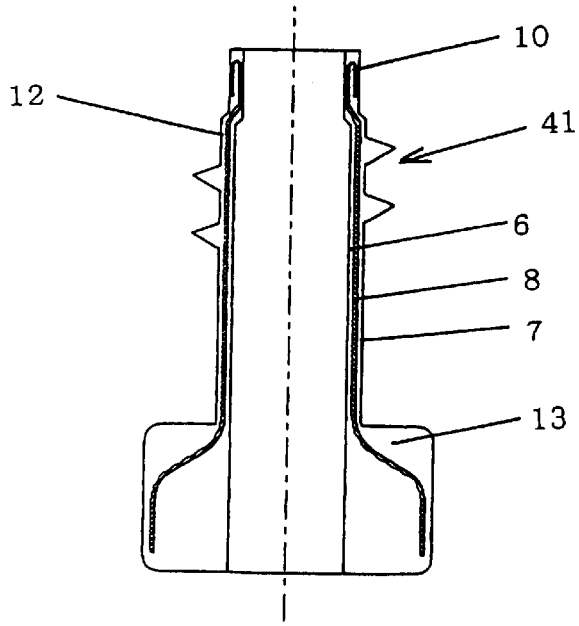
Figure 16:
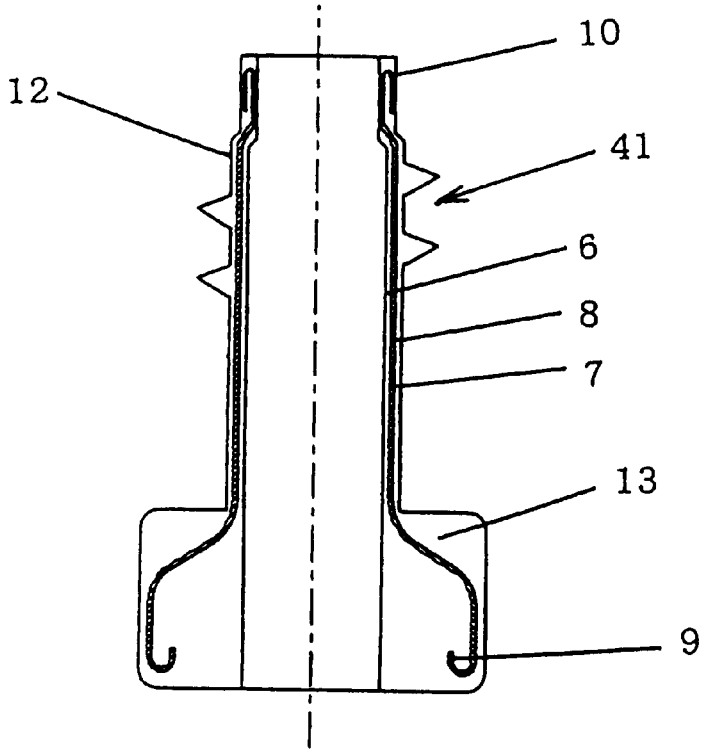

FIG. 14 to FIG. 16 are reference cross-sectional drawings of pouring mouth members for containers of the present invention when they are used as spouts applied to transfusion pouches or the like, wherein the pouring mouth members are not provided with conduit portions 14 which have been described with respect to the previous examples shown in FIG. 4 to FIG. 12.

A pouring mouth member 41 shown in FIG. 14 is, in the similar manner, comprised of a pouring mouth portion 12 and a seal portion 13. The layer constitution of the pouring mouth member 41 of this example is also comprised of an inner layer 6, an outer layer 7 and an intermediate resin layer 8 having barrier property and the pouring mouth member 41 is integrally formed with on opening portion of a transfusion pouch or the like by heatsealing the seal portion 13 to an opening portion of the transfusion pouch or the like.

In the pouring mouth member 41 of this example, a fold-back portion 9 is formed on an end portion of the intermediate resin layer 8 having barrier property disposed at a lower end portion of the seal portion 13 of the pouring mouth member 41 and the fold-back portion 9 is coated with the inner layer 6 and/or the outer layer 7.

Further, although an end portion of the intermediate resin layer 8 having barrier property disposed at an upper end portion of the pouring mouth member 41 is not exposed in this example, such an end portion may be exposed.

A pouring mouth member 41 shown in FIG. 15 is, in the similar manner, used as a spout which is integrally connected to a transfusion pouch or the like, wherein a fold-back portion 10 is formed on an end portion of an intermediate resin layer 8 having barrier property disposed at an upper end portion of a pouring mouth portion 12 and the fold-back portion 10 is coated with an inner layer 6 and/or an outer layer 7. Other constitutions of this example are substantially identical with those of the pouring mouth member 41 shown in FIG. 14.

A pouring mouth member 41 shown in FIG. 16 is used as a spout which is integrally connected to a transfusion pouch or the like in the similar manner, wherein fold-back portions 9, 10 are respectively formed on end portions of an intermediate resin layer 8 having barrier property disposed at a lower end portion of a seal portion 13 and at an upper end portion of a pouring mouth portion 12, and the fold-back portions 9, 10 are coated with an inner layer 6 and/or an outer layer 7. Other constitutions of this example are substantially identical with the corresponding constitutions of the pouring mouth member 41 shown in FIG. 14.

Although the present invention has been explained in conjunction with several examples, the present invention is not limited to the above-mentioned examples and includes other examples or modifications without departing from the scope of the present invention as described in claims.

What is claimed is:

1. A pouring mouth member having no exterior fold-back portion for a container wherein the pouring mouth member for a container comprises an intermediate resin layer having a barrier property and a fold-back portion formed on at least one end portion of the intermediate resin layer having a barrier property within an interior of the pouring mouth member.

2. A pouring mouth member for a container according to claim 1, wherein the fold-back portion is formed on a lower end portion of the intermediate resin layer having a barrier property and an upper end portion of the intermediate resin layer having a barrier property is sealed in the interior of inner and outer layer resins.

3. A pouring mouth member for a container according to claim 1, wherein the fold-back portion is formed on an upper end portion of the intermediate resin layer having a barrier property and a lower end portion of the intermediate resin layer having a barrier property is sealed in the interior of inner and outer layer resins.

4. A pouring mouth member for a container according to claim 1, wherein the fold-back portions are formed on an upper end portion and a lower end portion of the intermediate resin layer having a barrier property.

5. A pouring mouth member for a container according to claim 1, wherein the intermediate resin layer having a barrier property is arranged close to the outer layer resin.

6. A pouring mouth member for a container according to claim 1, wherein the pouring mouth member for a container is used as a nozzle which is integrally formed with a drum portion of a tubular container.

7. A pouring mouth member for a container according to claim 1, wherein the pouring mouth member for a container is used as a spout which is integrally formed with a pouch.

8. A pouring mouth member for a container to claim 7, wherein the intermediate resin layer having barrier property of the seal portion is continuously formed so that the intermediate resin layer is directed to distal end portions of the seal portion.

* * * * *